US011154979B2

(12) United States Patent
Ji et al.

(10) Patent No.: US 11,154,979 B2
(45) Date of Patent: Oct. 26, 2021

(54) WORKBENCH

(71) Applicant: Positec Power Tools (Suzhou) Co., Ltd., Jiangsu (CN)

(72) Inventors: Shaoshan Ji, Jiangsu (CN); Jialiang Zhang, Jiangsu (CN); Guojun Chen, Jiangsu (CN); Warren Brown, Mount Evelyn (AU)

(73) Assignee: Positec Power Tools (Suzhou) Co., Ltd., Suzhou (CN)

( * ) Notice: Subject to any disclaimer, the term of this patent is extended or adjusted under 35 U.S.C. 154(b) by 286 days.

(21) Appl. No.: 16/299,441

(22) Filed: Mar. 12, 2019

(65) Prior Publication Data

US 2019/0262983 A1 Aug. 29, 2019

Related U.S. Application Data

(63) Continuation of application No. PCT/CN2017/101635, filed on Sep. 13, 2017.

(30) Foreign Application Priority Data

Sep. 13, 2016 (CN) ..... 201621053364.7
Apr. 21, 2017 (CN) ..... 201720450732.X
(Continued)

(51) Int. Cl.
*B25H 1/04* (2006.01)
*B25H 1/14* (2006.01)

(52) U.S. Cl.
CPC ..... *B25H 1/04* (2013.01); *B25H 1/14* (2013.01)

(58) Field of Classification Search
CPC ..... A47B 3/00; A47B 3/002; A47B 3/006; A47B 3/06; A47B 3/008; A47B 3/02;
(Continued)

(56) References Cited

U.S. PATENT DOCUMENTS 6,286,824 B1 * 9/2001 Sagol ..... B25H 1/04 269/900
6,976,434 B2 * 12/2005 Roig ..... A47B 25/00 108/25
(Continued)

FOREIGN PATENT DOCUMENTS

CN 201415397 Y 3/2010
CN 102049766 A 5/2011
(Continued)

OTHER PUBLICATIONS

State Intellectual Property Office of the P.R. China, International Search Report and Written Opinion (English translation included) for PCT/CN2017/101635 dated Nov. 22, 2017.

*Primary Examiner* — Joseph J Hail
*Assistant Examiner* — Timothy B Brady
(74) *Attorney, Agent, or Firm* — Middleton Reutlinger

(57) ABSTRACT

Embodiments of the invention provide a workbench, includes: a workbench unit (110), including a first workbench unit (112) and a second workbench unit (114), the first workbench unit (112) and the second workbench unit (114) are rotatably connected; the first table unit (112) is provided with a first working surface (1120), and the second workbench unit (114) is provided with a second working surface (1140); a bracket (120), including a plurality of support legs (122) and detachably connected to the workbench unit (110); when the workbench unit (110) is in the first state, the first working surface (1120) and the second working surface (1140) together form a working surface supporting the workpiece; when the workbench unit (110) is in the second state, the first workbench unit (112) and the second workbench unit (114) form a bracket placement cavity (140) for at least partially accommodating the bracket (120).

4 Claims, 12 Drawing Sheets

(30) Foreign Application Priority Data

Apr. 26, 2017 (CN) ..... 201720450997.X
Apr. 26, 2017 (CN) ..... 201720451915.3

(58) Field of Classification Search
CPC ..... A47B 3/025; A47B 3/083; A47B 3/087; A47B 3/12; A47B 2003/008; A47B 2003/0806; A47B 2003/0835; A47B 2200/0035; A47B 2200/0036; A47B 2200/0037; B25H 1/00; B25H 1/04; B25H 1/06; B25H 1/08; B25H 1/12; B25H 1/14
USPC ..... 108/166–169; 269/16
See application file for complete search history.

(56) References Cited

U.S. PATENT DOCUMENTS

| | | | | |
|---|---|---|---|---|
| 8,459,734 | B2 * | 6/2013 | Herschler | A47B 3/10 297/139 |
| 9,770,096 | B1 * | 9/2017 | Meyer | A47B 3/10 |
| 2006/0254480 | A1 | 11/2006 | Haimoff et al. | |
| 2010/0038500 | A1 * | 2/2010 | Hsu | B25H 1/04 248/166 |
| 2011/0012392 | A1 * | 1/2011 | Herschler | A47B 3/12 297/139 |
| 2016/0227919 | A1 * | 8/2016 | Turner | A47B 3/083 |
| 2016/0270522 | A1 * | 9/2016 | Winter | A47B 3/087 |

FOREIGN PATENT DOCUMENTS

| | | | |
|---|---|---|---|
| CN | 205238204 | U | 5/2016 |
| CN | 206200906 | U | 5/2017 |
| WO | 2016098117 | A1 | 6/2016 |

* cited by examiner

WORKBENCH

BACKGROUND

Technical Field

The present invention relates to the field of working devices and in particular, to a workbench.

Related Art

A conventional workbench usually includes a workbench unit and a support leg component for supporting the workbench unit. When an operator needs to work by the workbench, he can put a workpiece on the workbench and then process a workpiece by a power tool.

SUMMARY

It is necessary to provide a portable workbench and a portable workbench component for the technical problem that a workbench is not easy to carry and is not easy to store due to a relatively large volume.

Embodiments of the present invention provide a workbench, where the workbench includes: a workbench unit, including a first workbench unit and a second workbench unit, where the first workbench unit and the second workbench unit are rotatably connected, the first workbench unit is provided with a first working surface, and the second workbench unit is provided with a second working surface; and a bracket, including multiple support legs and detachably connected to the workbench unit, wherein when the workbench unit is in a first state, the first working surface and the second working surface are coplanar to form a working surface for supporting a workpiece, and when the workbench unit is in a second state, the first workbench unit and the second workbench unit form a bracket placement cavity for at least partially accommodating the bracket.

In an embodiment, the first workbench unit and the second workbench unit are same in shape and size.

In an embodiment, the first workbench unit includes a first portion extending along a longitudinal direction and a second portion adjacent to the first portion, and the second portion includes multiple raised portions spaced from each other and recessed portions corresponding to the raised portions, and the raised portions extend from the first portion in a manner of being perpendicular to the longitudinal direction.

In an embodiment, the first portion defines a central line perpendicular to the longitudinal direction, a distance between a center of any raised portion to the central line is equal to a distance between a center of any corresponding recessed portion to the central line, a dimension of any raised portion along the longitudinal direction is equal to a dimension of any corresponding recessed portion along the longitudinal direction.

In an embodiment, a dimension of at least one of the raised portions along the longitudinal direction is not equal to a dimension of another raised portion along the longitudinal direction.

In an embodiment, the first workbench unit is provided with a first leg portion and a second leg portion, the first leg portion and the second leg portion extend from the surface opposite the first working surface; the second workbench unit is provided with a first leg portion and a second leg portion, the first leg portion and the second leg portion extend from the surface opposite the second working surface.

In an embodiment, in the second state, the first leg portion of the first workbench unit abuts against a second leg portion of the second workbench unit, and the second leg portion of the first workbench unit abuts against a first leg portion of the second workbench unit.

In an embodiment, the first workbench unit is provided with a first side surface, a second side surface and a third side surface, the first side surface is parallel to the longitudinal direction, the second side surface and the third side surface are perpendicularly connected to the first side surface, the first leg portion extend from the first side surface and the second side surface and the second leg portion extend from the first side surface and the third side surface.

In an embodiment, when the workbench unit is in the second state, the first leg portion of the first workbench unit and the second leg portion of the second workbench unit cooperate to form a first curved outline, the second leg portion of the first workbench unit and the first leg portion of the second workbench unit cooperate to form a second curved outline.

In an embodiment, the first workbench unit is provided with reinforcing ribs away from the working surface, and the reinforcing ribs comprise a first reinforcing rib extending along a longitudinal direction, a second reinforcing rib perpendicular to the first reinforcing rib, and a third reinforcing rib and a fourth reinforcing rib, the third reinforcing rib and the fourth reinforcing rib both form an acute angle with the first reinforcing rib.

In an embodiment, the workbench further comprises a rotating shaft, the first workbench unit and the second workbench unit are rotatable relative to each other by the rotating shaft, one free end of the rotating shaft is connected to the first workbench unit by a first pressing part, and the other free end of the rotating shaft is connected to the second workbench unit by a second pressing part. In an embodiment, when the workbench unit is in the first state, the first workbench unit and the second workbench unit are centrosymmetric with respect to a geometric centre of the workbench unit.

In an embodiment, the first workbench unit is provided with a first concave portion, the second workbench unit is provided with a second concave portion, in the second state, the first concave portion and the second concave portion form the bracket placement cavity, inner walls of the first concave portion and inner walls of the second concave portion clamp the bracket to restrict movement of the bracket in a direction perpendicular to a longitudinal direction.

In an embodiment, the bracket placement cavity is provided with an elastic skidproof structure in contact with the bracket, and the elastic skidproof structure restricts the bracket to move along the longitudinal direction.

In an embodiment, the support leg mounting block is completely accommodated within the concave portion and does not protrude from the first working surface.

In an embodiment, the workbench further comprises a connecting piece, when the workbench unit is in the second state, the connecting piece is detachably connected to side portions of the first workbench unit and the second workbench unit, the side portions are away from the rotation axis.

In an embodiment, the first workbench unit is provided with a recess from the first working surface and a through hole penetrating the recess, and the workbench comprises a support leg mounting block, the support leg mounting block can be set in two state, in one state, the support leg mounting block passes through the through hole, in another state, after the support leg mounting block is rotated, the support leg mounting block abuts against an inner wall of the recess.

Embodiments of the present invention further provide a workbench, including:

a workbench unit, comprising two sub workbench units which are identical in structure and size, wherein the sub workbench unit is provided with a sub working surface, the sub working surfaces of the sub workbench units adjoin to jointly form a working surface, the workbench unit comprises a first portion extending along a longitudinal direction and a second portion adjacent to the first portion, and the second portion comprises multiple raised portions spaced from each other and recessed portions corresponding to the raised portions, and the raised portions extend from the first portion in a manner of being perpendicular to the longitudinal direction; and a rotating shaft, pivotally connected to the two sub workbench units and extending through the second portions of the two sub workbench units, wherein the first portion defines a central line perpendicular to the longitudinal direction, a distance between a center of any raised portion to the central line is equal to a distance between a center of any corresponding recessed portion to the central line, a dimension of any raised portion along the longitudinal direction is equal to a dimension of any corresponding recessed portion along the longitudinal direction.

In an embodiment, the sub workbench unit is provided with a first leg portion and a second leg portion, the first leg portion and the second leg portion extend from the surface opposite the first working surface, and after the two sub workbench units cooperate, the first leg portions and the second leg portions support the workbench.

In an embodiment, the first portion defines the longitudinal direction, the first portion and the second portion are connected to one side perpendicular to the longitudinal direction, the first portion is provided with n positioning holes arranged along the longitudinal direction, the positioning holes are arranged to form a first positioning hole group, the second portion is provided with n/2 positioning holes arranged along the longitudinal direction, n is an even number greater than 0, and the positioning holes of the second portion and some of the positioning holes of the first portion are symmetric with respect to a straight line parallel to the longitudinal direction.

In an embodiment, after the two sub workbench units cooperate, three longitudinally spaced positioning hole groups are formed, in every positioning hole group, the spacing between corresponding positioning holes is the same, centers of the positioning holes of the second portions of the two sub workbench units are collinear so that a second positioning hole group is formed, and the first positioning hole group and the second positioning hole group are symmetric with respect to a straight line parallel to the longitudinal direction.

In an embodiment, the second portion comprises a first recessed portion, a first raised portion, a second recessed portion, a second raised portion, a third recessed portion, a third raised portion, a fourth recessed portion, and a fourth raised portion, which are sequentially arranged along the longitudinal direction, and the positioning holes of the second portion comprise a first positioning hole disposed in the first raised portion, two second positioning holes disposed in the second raised portion, and a third positioning hole disposed in the third raised portion.

The foregoing portable workbench component can be spliced from the foregoing portable workbench into an operation platform according to actual needs required by an operator. In this way, the foregoing portable workbench component, in addition to having functions of being easy to carry and a relatively small volume, also has wide applicability of being spliced into workbench components of different sizes according to needs of different workplaces.

DETAILED DESCRIPTION

To make an objective, technical solutions, and advantages of the present invention clearer, the present invention is further described in detail below with reference to the accompanying drawings and embodiments. It should be understood that specific embodiments described herein are only used to explain the present invention but are not used to limit the present invention.

Figure 1:
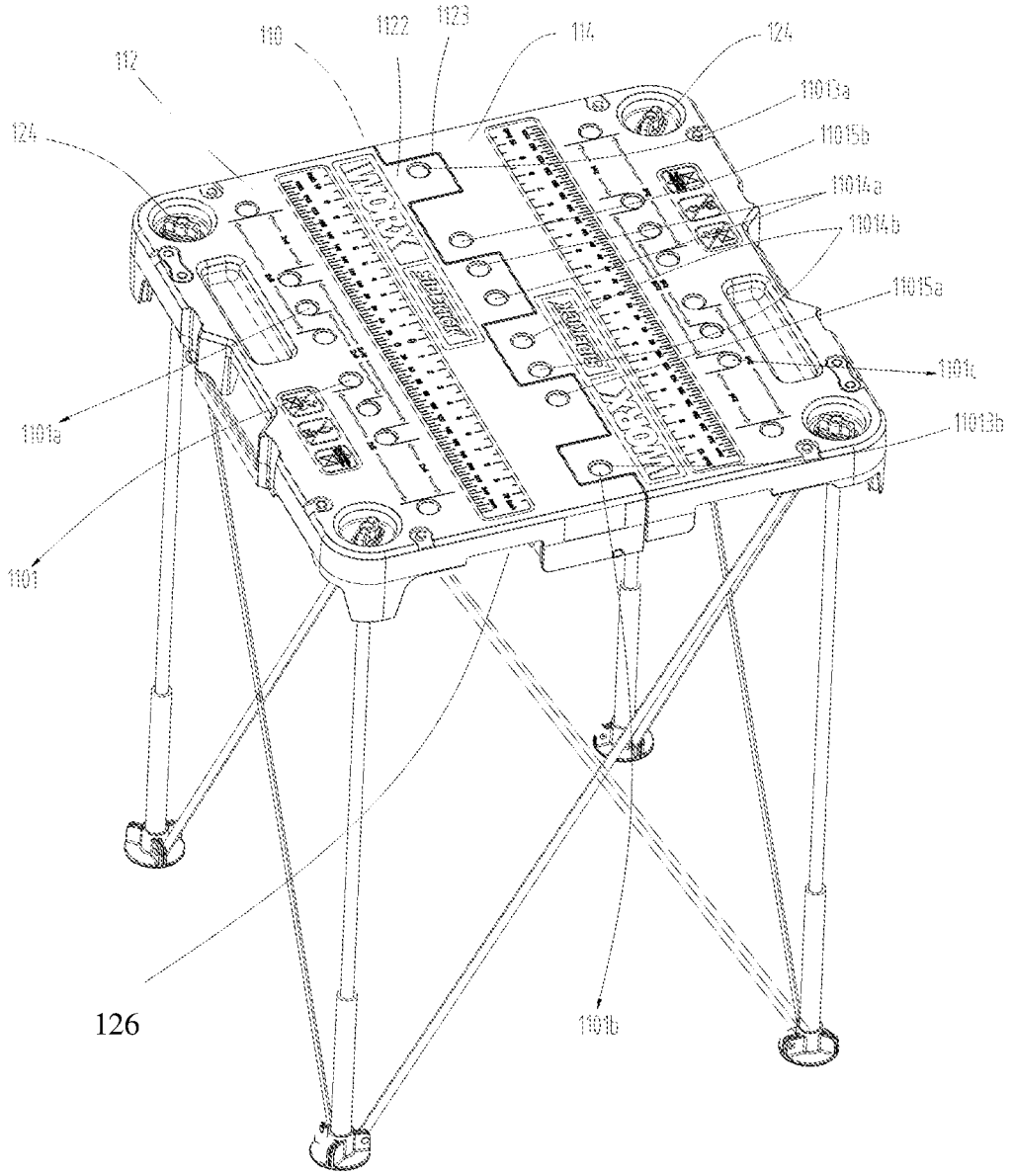
FIG. 1 is a perspective view of the workbench according to an example embodiment of the present invention, this moment the workbench is in a first state.
Figure 2:
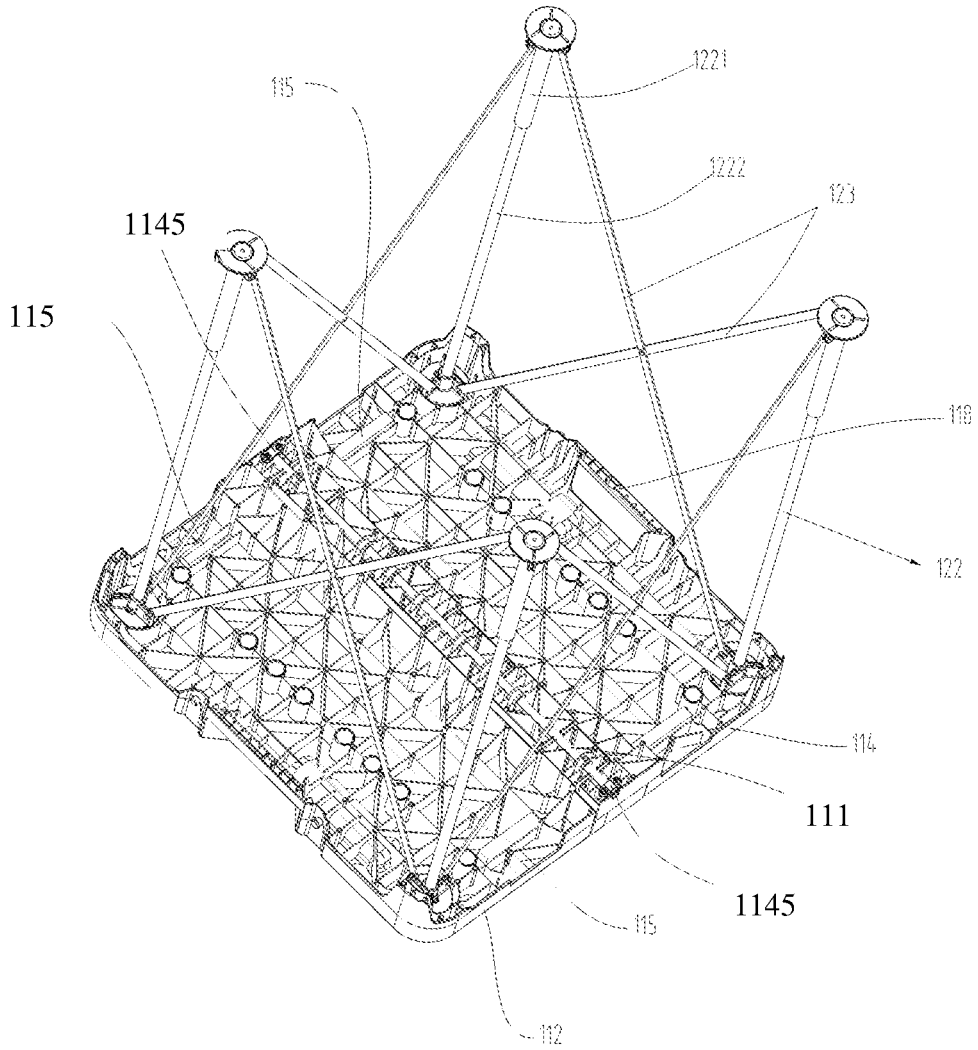
FIG. 2 is a perspective view from another angle of the workbench according to the example embodiment of the present invention, this moment the workbench is in a first state.
Figure 7:
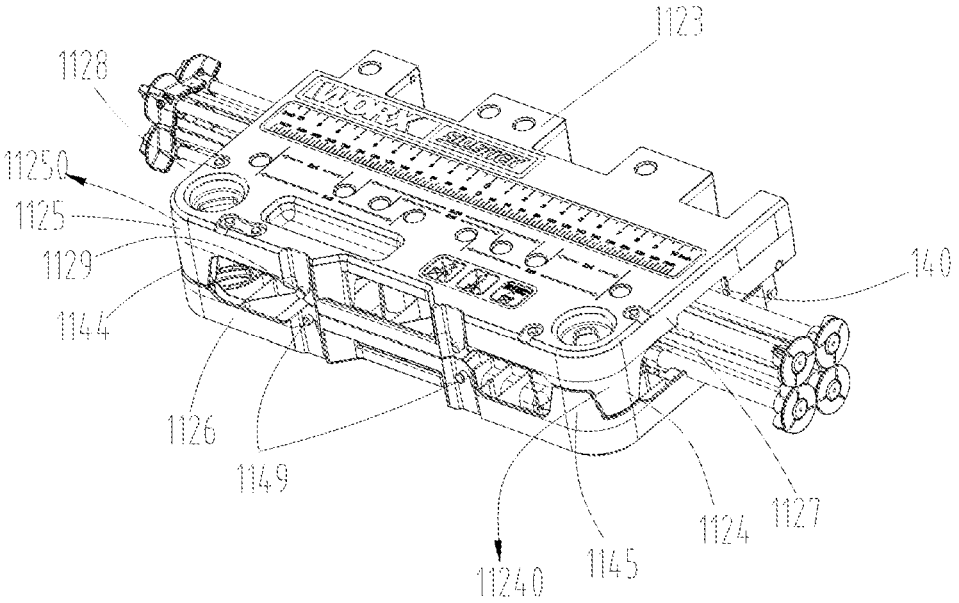
FIG. 7 is a perspective view of the workbench according to an example embodiment of the present invention, this moment the workbench is in a second state and the connecting piece is not shown.

With reference to FIG. 1, FIG. 2, and FIG. 7, a workbench of this embodiment includes workbench unit 110 and a bracket 120 detachably connected to the workbench unit 110. The workbench unit 110 includes a first workbench unit 112 and a second workbench unit 114, the first workbench unit 112 and the second workbench unit 114 are same in shape and size. During production, only one mold is needed, lowering mold costs.

Figure 3:
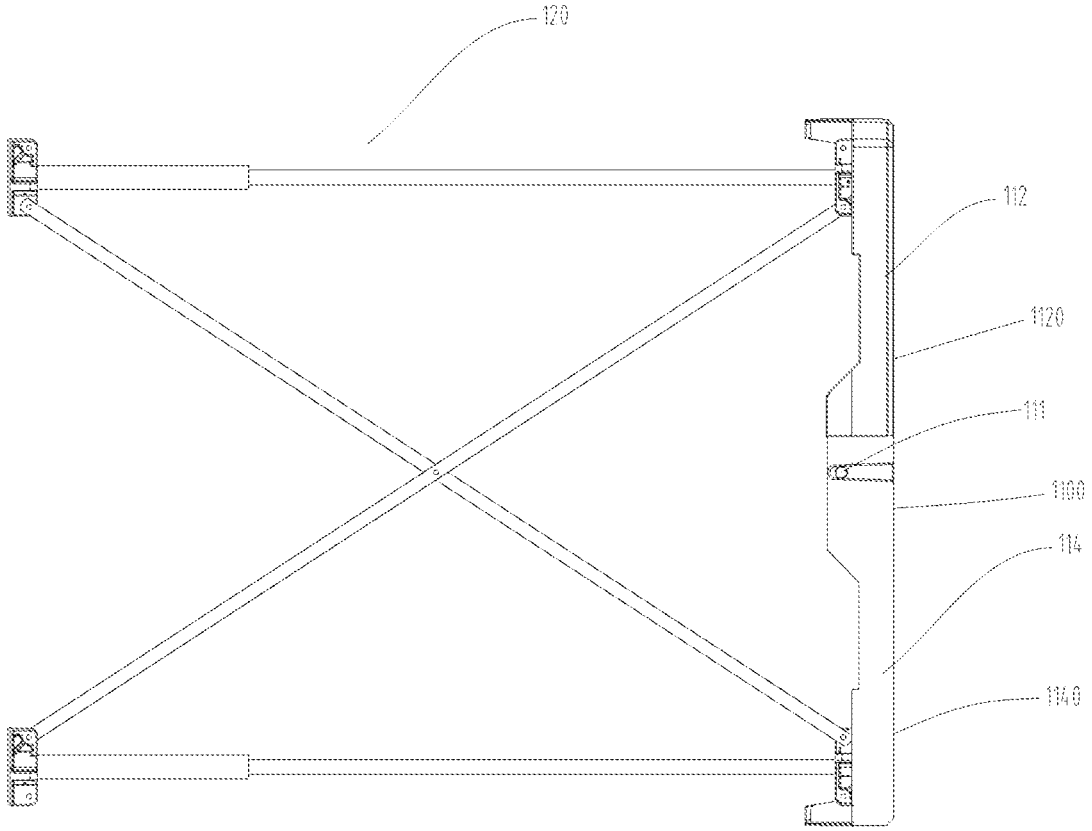
FIG. 3 is a side view of the workbench according to the example embodiment of the present invention, this moment the workbench is in a first state.

With reference to FIG. 3 and FIG. 7, the workbench unit further includes a rotating shaft 111 that connects the first workbench unit 112 and the second workbench unit 114. The first workbench unit 112 and the second workbench unit 114 can rotate relative to the rotating shaft 111 to form a bracket placement cavity 140. In addition, after being folded, the bracket is partially accommodated in the bracket placement cavity 140, and two ends are exposed. That is, the workbench can be set in two states, that is, a working state and a folded state (that is, a transportation state and a storage state). The working states include a first working state of which the bracket 120 is connected to the workbench unit 110 and a second working state of which the bracket 120 is not connected to the workbench unit 110 (detailed descriptions are provided below). Correspondingly, the workbench unit 110 is also provided with an unfolded state and a folded state, and the unfolded state corresponds to two working states. In the unfolded state, the first workbench unit 112 and the second workbench unit 114 are centrosymmetric with respect to a geometric center of the workbench unit 110.

With reference to FIG. 1 to FIG. 3, the bracket 120 includes support legs 122 and connecting rods 123, and the bracket 120 can be folded and unfolded. The top and the bottom of the support leg 122 are provided with a support leg mounting base respectively, and a support leg mounting block 124 is disposed on an upper surface of the support leg mounting base at the top of the support leg 122, to be connected to the workbench unit 110. The crossing connecting rods 123 are further provided between two support legs corresponding to each side of the workbench unit 110, two connecting rods 123 are hinged together at the crossing, and end portions are connected to the support leg mounting bases. The connecting rods 123 are used to connect the support legs 122 to form a whole, that is, the bracket. The support legs 122 are divided into two parts, a bottom support leg 1221 and an upper support leg 1222. The bottom support leg 1221 is provided with a blind hole, and the upper support leg 1222 is inserted into the blind hole of the bottom support leg 1221 and can move along the blind hole, so that the bracket composed of the support legs 122 and the connecting rods 123 can be folded and unfolded.

Figure 4:
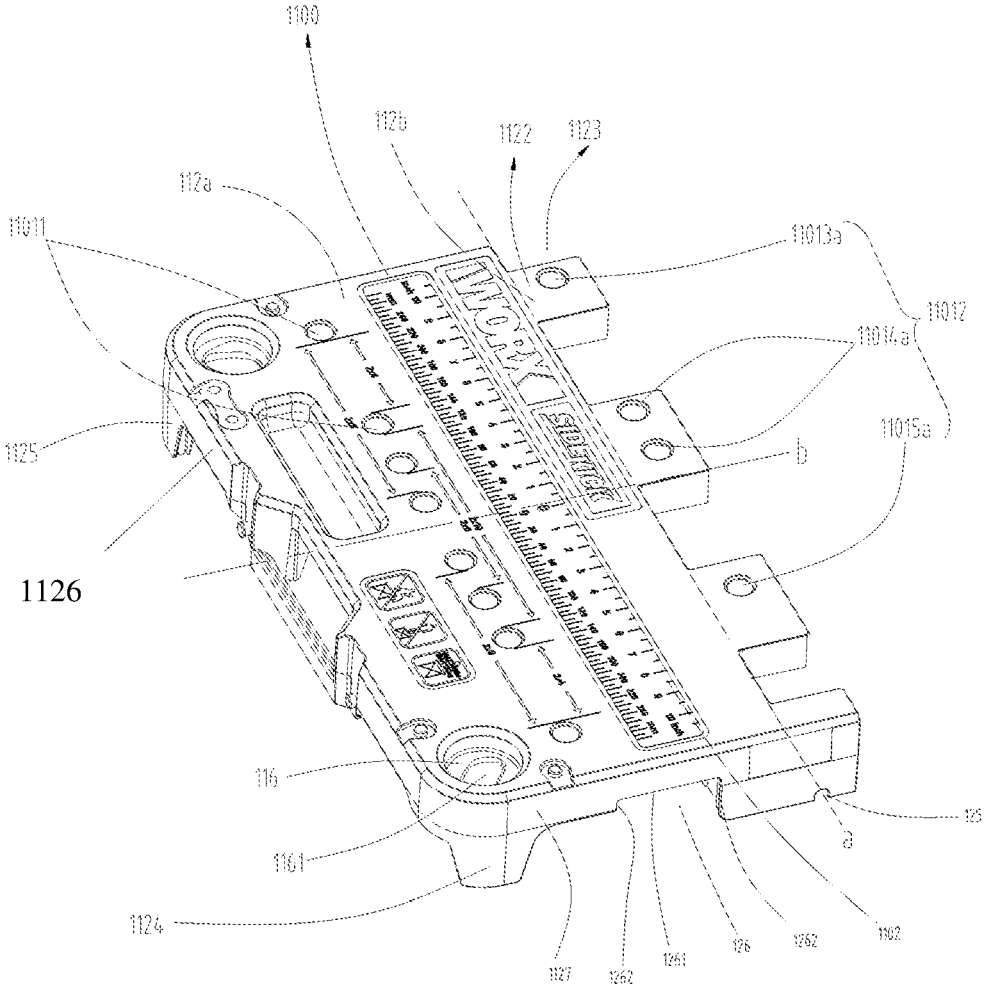
FIG. 4 is an enlarged view of the first workbench unit of the workbench according to the example embodiment of the present invention.
Figure 5:
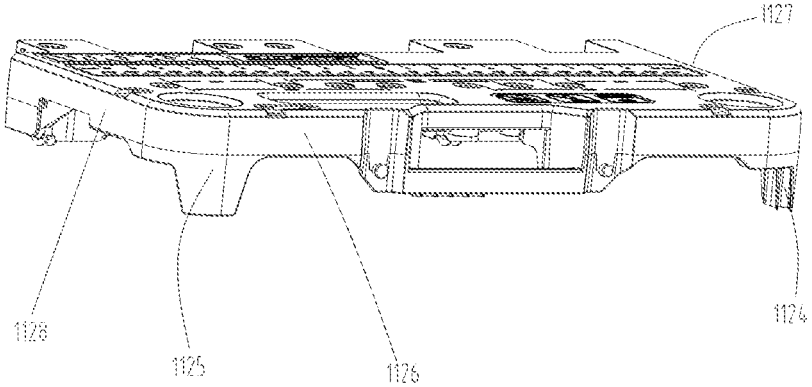
FIG. 5 is an enlarged view from another angle of the first workbench unit of the workbench according to the example embodiment of the present invention.
Figure 6:
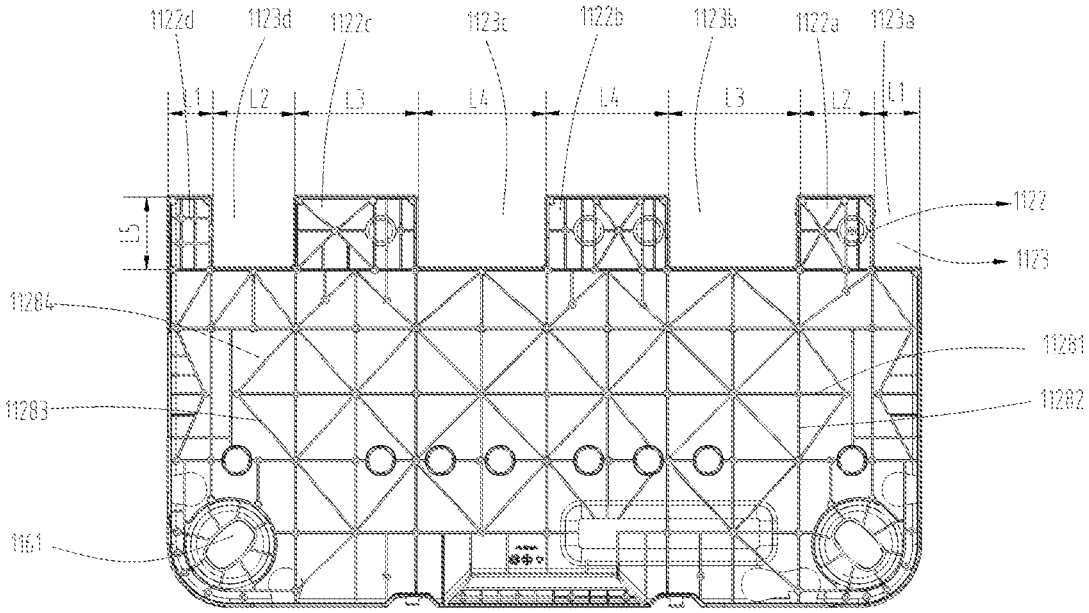
FIG. 6 is an enlarged bottom view of the first workbench unit of the workbench according to the example embodiment of the present invention.

Descriptions are provided below by using the first workbench unit 112 as an example. With reference to FIG. 4 to FIG. 6, the first workbench unit 112 includes a rectangular first portion 112*a* and a second portion 112*b* adjoining to the first portion. The second portion 112*b* includes multiple raised portions 1122 spaced from each other and recessed portions 1123 corresponding to the multiple raised portions. The second portion may be considered to be rectangular, and a rectangle of the second portion 112*b* and a rectangle of the first portion 112*a* are aligned along a longitudinal direction. An upper surface of the first portion 112*a* and an upper surface of the second portion 112*b* are co-planar and adjoin to form a first working surface 1120 for supporting a workpiece. The first portion 112*a* is provided with a recess 116 facing downwards from the first working surface 1120, the recessed portion 116 is provided with a roughly rectangular through hole 1161 through downwards, and the through hole 1161 is used to fasten the bracket 120. A size of the through hole 1161 is roughly the same as that of the support leg mounting block 124, so as to allow the support leg mounting block 124 to pass through. After passing through the through hole 1161, the support leg mounting block 124 can be manually rotated for an angle so that the support leg mounting block 124 is staggered from the through hole 1161 in positions, so that the support leg mounting block 124 and a bottom wall of the recessed portion 116 are in contact and abut against each other, so as to mount the support legs 122 onto the first workbench unit 112. In another embodiment, the through hole 1161 may be of another shape that allows the support mounting block 124 to pass through, and enables the recessed portion 116, after rotation, to prevent the support mounting block 124 from being separated, ensuring stable connection between the workbench unit 110 and the bracket 120.

It should be noted that the recessed portion 116 may completely accommodate the support leg mounting block 124, preventing the support leg mounting block 124 from protruding from the working surface 1100 (or the first working surface 1120) so as to affect the supported workpiece.

The first workbench unit 112 is provided with a first side surface 1126, a second side surface 1127 and a third side surface 1128, the first side surface 1126 is parallel to a longitudinal direction, the second side surface 1127 and the third side surface 1128 are perpendicular to the longitudinal direction, that is, the second side surface 1127 and the third side surface 1128 are disposed on two longitudinal sides of the first workbench unit 112. The first workbench unit 112 is provided with a first leg portion 1124 and a second leg portion 1125 at a vertex angle, far away from the second portion 112*b*, of the first portion 112*a*. The first leg portion 1124 extends from the first side surface 1126 and the second side surface 1127 of the first workbench unit 112 along a direction away from the first working surface 1120. The second leg portion 1125 extends from the first side surface 1126 and the third side surface 1128 of the first workbench unit 112 along a direction away from the first working surface 1120, that is, the first leg portion 1124 and the second leg portion 1125 are same in the extension direction and are both formed by extending from two side surfaces. Certainly, the first leg portion 1124 (or the second leg portion) may also extend from only one side surface. When the workbench unit 110 are in the unfolded state and are not connected to the bracket 120, the first leg portion 1124 and the second leg portion 1125 protrude from bottom surfaces of the first portion 112*a* and the second portion 112*b*, and the bottom surfaces are opposite the first working surface 1120. The second workbench unit 114 is also provided with a first leg portion 1144 and a second leg portion 1145, the first leg portion 1144 and the second leg portion 1145 extend from the bottom surface opposite the second working surface 1140. The first leg portion 1124 and the second leg portion 1125 of the first workbench unit 112 and a first leg portion 1144 and a second leg portion 1145 of the second workbench unit 114 are together used as support of the workbench. The workbench (with no bracket) in this case is a relatively low workbench, that is, in the foregoing second working state.

In addition, in the extension directions of the first leg portion 1124 and the second leg portion 1125, transverse dimensions (dimensions in directions perpendicular to the extension directions) of the first leg portion 1124 and the second leg portion 1125 both gradually decrease along the extension directions. Reasons for such setting are described below.

The raised portions 1122 and the recessed portions 1123 are arranged in a staggered manner. In a direction b perpendicular to the longitudinal direction a of the second portion 112*b*, the raised portions 1122 and the recessed portions 1123 are all kept aligned. Specifically, in the longitudinal direction of the second portion 112*b*, an arrangement sequence of the raised portions 1122 and the recessed portions 1123 is: a recessed portion 1123*a*, a raised portion 1122*a*, a recessed portion 1123*b*, a raised portion 1122*b*, a recessed portion 1123*c*, a raised portion 1122*c*, a recessed portion 1123*d*, and a raised portion 1122*d*. A longitudinal dimension (that is, a dimension in the longitudinal direction of the second portion 112*b*; the following longitudinal dimension are similar) of the recessed portion 1123*a* and a longitudinal dimension of the raised portion 1122*d* are equal and are L1. A longitudinal dimension of the recessed portion 1123*b* and a longitudinal dimension of the raised portion 1122*c* are equal and are L3. A longitudinal dimension of the recessed portion 1123*c* and a longitudinal dimension of the raised portion 1122*b* are equal and are L4. A longitudinal dimension of the recessed portion 1123*d* and a longitudinal dimension of the raised portion 1122*a* are equal and are L2. L4>L3>L2>L1. The raised portions 1122 and the recessed portions 1123 are same in dimension along the direction perpendicular to the longitudinal direction, and both are L5. In another embodiment, the dimension of at least one of the raised portions 1122 along the longitudinal direction is not equal to a dimension of another raised portion along the longitudinal direction. It should be noted that an adjoining part of the raised portion 1122*b* and the recessed portion 1123*c* is a line segment, and the line segment divides a longitudinal length of the second portion 112*b* into two parts. The first portion defines a central line perpendicular to the longitudinal direction a. A distance (L2/2+L3+L4) between a center of any raised portion (for example, 1122*a*) to the central line is equal to a distance (L2/2+L3+L4) between a center of any corresponding recessed portion (1123*d*) to the central line. Therefore, positions of the raised portions 1122 and positions of the recessed portions 1123 may correspond one to one on two sides of the central line. According to such setting, the first workbench unit 112 may shape-cooperate with the second workbench unit 114, the first workbench unit 112 and the second workbench unit 114 are same in shape and size, to finally compose a rectangular regular working surface.

The first workbench unit 112 is provided with several positioning holes 1101 penetrating the first working surface 1120. The positioning holes 1101 include n positioning holes 11011 disposed in the first portion 112*a* and *n*/2 positioning holes 11012 disposed in the second portion 112*b*, and *n* is an even number greater than 0. The positioning holes 11011 of the first portion 112*a* are aligned with each other in the direction b, to form a first positioning hole group 1101*a*, and the positioning holes 11012 of the second portion 112*b* are also aligned with each other in the direction b. Specifically, the positioning holes 11012 of the second portion 112*b* are disposed in the raised portions 1122*a*, 1122*b*, and 1122*c*, and the raised portion 1122*d* is not provided with second positioning holes due to its relatively small size. Specifically, the positioning holes 11012 of the second portion 114 include a first positioning hole 11013*a* disposed in a first raised portion, two second positioning holes 11014*a* disposed in a second raised portion, and a third positioning hole 11015*a* disposed in a third raised portion.

It can be known with reference to FIG. 4 that in the direction b perpendicular to the longitudinal direction a, the positioning holes 11012 of the second portion 112*b* and some of the positioning holes 11011 of the first portion 112*a* are symmetric relative to a straight line parallel to the longitudinal direction. Because the second workbench unit 114 and the first workbench unit 112 are same in structure, when the second workbench unit 114 and the first workbench unit 112 cooperate, that is, when the second portion 112*b* of the second workbench unit 114 and the first workbench unit 112 perform shape-cooperation, the positioning holes 11013*b*, 11014*b*, and 11015*b* of the second portion of the second workbench unit 114 and the positioning holes 11012 of the second portion of the first workbench unit 112 are aligned along the direction b and are staggered from each other in the direction a. In the direction b, the positioning holes 11012 of the second portion of the first workbench unit 112 and the positioning holes of the second portion of the second workbench unit 114 are combined to form a list of new positioning holes with collinear centers, and the positioning holes in this list and the positioning holes 11011 are aligned with the positioning holes 11011 of the first portion 112*a* of the first workbench unit one by one. That is, the second portions 112*b* of the first workbench units 112 and the second portion (not marked with a number) of the second workbench unit 114 together form a second positioning hole group 1101*b* similar to the first positioning hole group 1101*a*. Arrangement of the second positioning hole group 1101*b* and that of the first positioning hole group 1101*a* are identical (that is, hole distances, sizes, and the like are all the same), that is, the second positioning hole group 1101*b* are symmetric to the first positioning hole group 1101*a* relative to a straight line parallel to the direction b. When the workbench is in a first state, the workbench unit 110 include the first positioning hole group 1101*a* of the first workbench unit 112, the second positioning hole group 1101*b*, and a third positioning hole group 1101*c* of the second workbench unit 114, that is, three groups of identical positioning hole groups in total. Three groups of positioning hole groups 1101*a*, 1101*b*, and 1101*c* are spaced, and the spacing between corresponding positioning holes is the same. In this way, the workbench can clamp workpieces with more lengths at the same time. For example, when a workpiece with relatively small length (a size in a direction perpendicular to the longitudinal direction) is clamped, the second positioning hole group 1101*b* and the first positioning hole group 1101*a* (or the third positioning hole group 1101*c*) with relatively small distances are selected. For example, when a workpiece with a relatively large length is clamped, the first positioning hole group 1101*a* and the third positioning hole group 1101*c* with relatively large distances are selected. In this way, better clamping stability can be obtained, and the workbench unit 110 are used to the maximum limit.

With reference to FIG. 9 to FIG. 12, in another implementation, the workbench further includes at least two clamping blocks 190. The clamping block 190 includes a pin 191 and a clamping portion 192. The pin 191 is inserted into the positioning holes 1101 or the second positioning holes. Clamping space is formed between two clamping portions 192. In the longitudinal direction a, a distance between two positioning holes is predetermined. Using the second positioning hole group 1101*b* as an example, with reference to FIG. 1, when the workbench unit is in the first state, when the pins 191 are inserted into the first positioning hole 11013*a* of the first workbench unit 112 and the third positioning hole 11015*b* of the second workbench unit 114, 2*4 inch clamping area is formed between the clamping portions 192. When the pins 191 are inserted into the first positioning hole 11013*a* of the first workbench unit 112 and the relatively far second positioning hole 11014*a* of the first workbench unit 112, a 2*8 inch clamping area is formed between the clamping portions 192. When the pins 191 are inserted into the third positioning hole 11015*b* of the second workbench unit 114 and the relatively far third positioning hole 11015*a* of the first workbench unit 112, a 2*10 inch clamping area is formed between the clamping portions 192. When the pins 191 are inserted into a second positioning hole 11014*a* of the first workbench unit 112 and the relatively far second positioning hole 11014*b* of the second workbench unit 114, a 2*6 inch clamping area is formed between the clamping portions 192. When the pins 191 are inserted into a second positioning hole 11014*b* of the second workbench unit 114 and the first positioning hole 11013*a* of the first workbench unit 112, a 2*10 inch clamping area is formed between the clamping portions 192. When the pins 191 are inserted into a second positioning hole 11014*a* of the first workbench unit 112 and the relatively far second positioning hole 11014*b* of the second workbench unit 114, a 2*6 inch clamping area is formed between the clamping portions 192. A 2*6 inch or 2*8 inch clamping area can also be formed at the other side of the rotating shaft center. Details are not provided herein. In this way, standard workpieces with sizes of 2*4, 2*6, 2*8, and 2*10 can be clamped. In this way, No matter which side of the two longitudinal sides is selected, the workpiece can be portably clamped, satisfying different habits of a left-handed user or a right-handed user.

Figure 10:
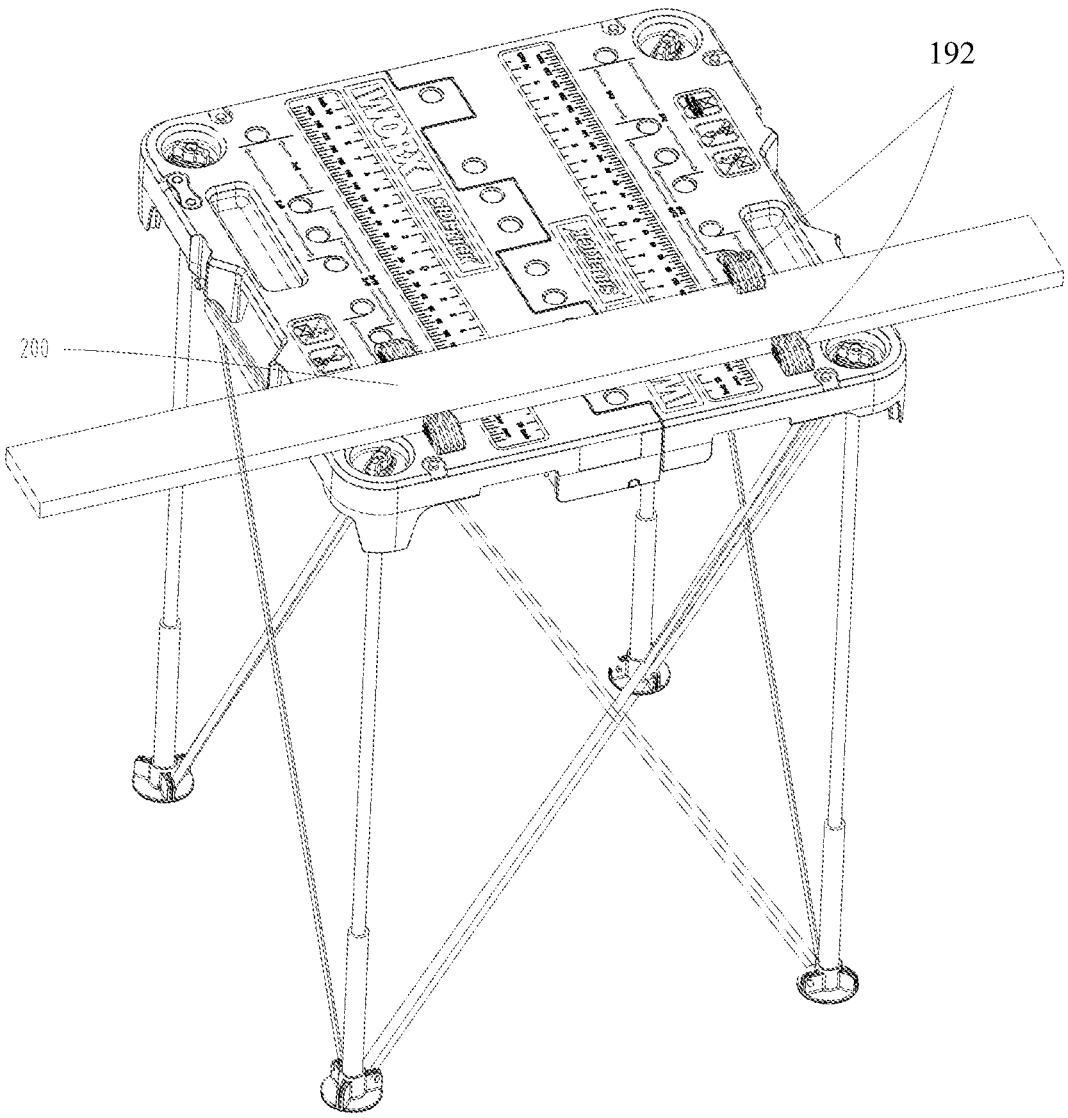
FIG. 10 is a perspective view of the workbench according to an example embodiment of the present invention, this moment the workbench is in a first state and the clamped workpiece is shown.
Figure 11:
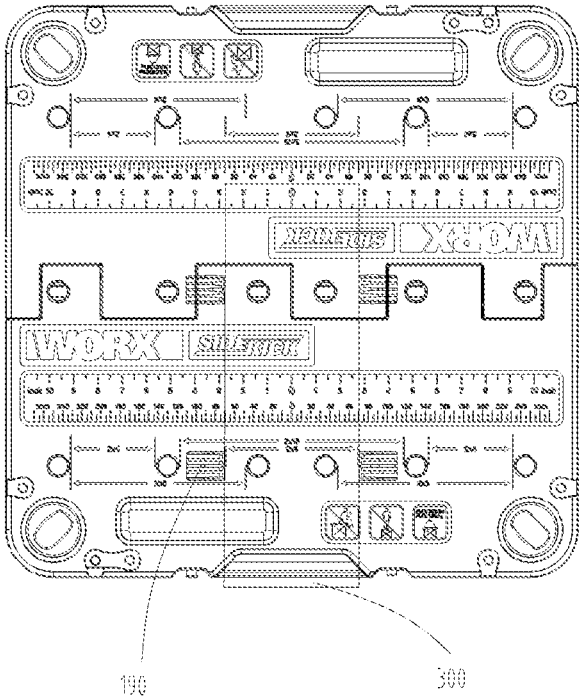
FIG. 11 is a perspective view of the workbench according to an example embodiment of the present invention, this moment the workbench is in a first state and the clamped workpiece is shown.
Figure 12:
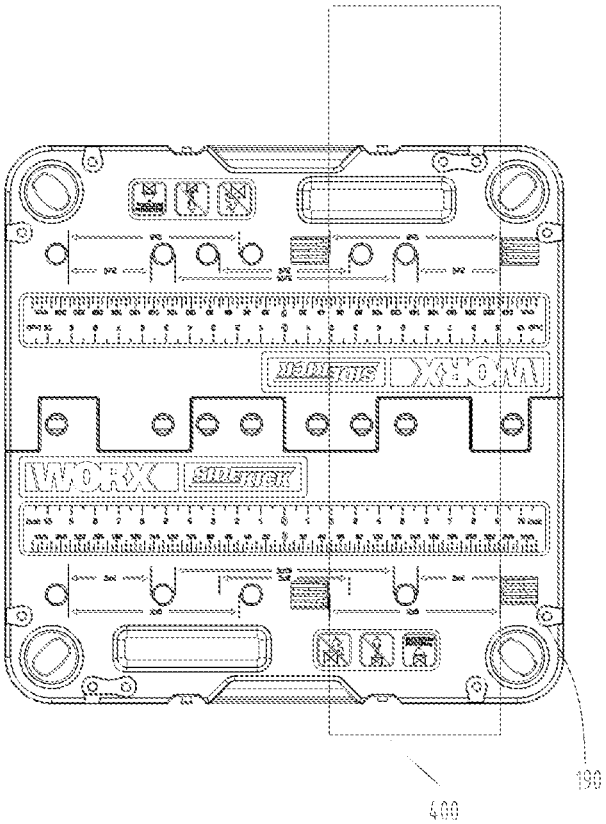
FIG. 12 is a perspective view of the workbench according to an example embodiment of the present invention, this moment the workbench is in a first state and the clamped workpiece is shown.

A scale 1102 corresponding to the positioning holes 1101 is provided at sides of the positioning holes 1101, so that a user can intuitively adjust a clamping size. FIG. 10 is a perspective view of the workbench clamping a standard 2*4 inch wood 200. FIG. 11 and FIG. 12 are perspective views of the workbench clamping a standard 2*6 inch short workpiece 300 and a 2*8 inch workpiece 400 respectively. To help observe corresponding sizes, the workpieces in FIG. 11 and FIG. 12 are illustrated to be transparent.

Certainly, formation of the second positioning hole group 1101*b* also depends on structures of the raised portions 1122. If a size of each raised portion is equal (that is, L1=L2=L3=L4), some of positioning holes just cross the raised portions 1122 and the recessed portions 1123, that is, two half holes can be made to form positioning holes after the two workbench units cooperate. Such positioning holes are meaningless because the positioning holes consist of two parts (small displacement exists) and are unstable during positioning so as to cause large errors. Only when the raised portions are not all equal in size, the second positioning hole group 1101*b* similar to the first positioning hole group 11011 can be formed.

With reference to FIG. 2 and FIG. 6 below, reinforcing ribs are provided at one side, away from the first working surface 1120, of the first workbench unit 112, to improve support strength. The reinforcing ribs includes a first rib part 11281 parallel to the longitudinal direction, a second rib part 11282 perpendicular to the first rib part 11281, and a third rib part 111283 and a fourth rib part 11284 that form an acute angle with the first rib part 11281. In this embodiment, the first rib part 11281 forms a 45° angle with both the third rib part 11283 and the fourth rib part 11284, and the third rib part 11283 is disposed perpendicular to the fourth rib part 11284. The first rib part 11281, the second rib part 11282, the third rib part 11283, and the fourth rib part 11284 mutually cross, so as to form several "米" shapes at a lower side of the first workbench unit. A "米"-shaped reinforcing rib 119 can disperse stress applied to the workbench unit in four directions, increasing support strength and helping prolonging a service life of the workbench.

In this embodiment, the reinforcing rib is only formed in the first portion 112*a*. No reinforcing rib is additionally disposed in the second portion 112*b* because the second portion 112*b* has a structure of relatively large strength (the structure is used to accommodate and support the rotating shaft 111, and therefore requires relatively high strength).

With reference to FIG. 4 and FIG. 5, the first portion 112*a* is provided with a concave portion 126 formed at a lower side thereof (the side connected to the bracket), and the concave portion 126 extends along the longitudinal direction a and penetrates a side surface 1127 of the first portion 112*a* and another side surface 1128 parallel to the side surface 1127.

The second portion 112*b* is provided with multiple support holes 125 (FIG. 4) for accommodating the rotating shaft 111. The rotating shaft penetrates the support holes 125 and is rotatably supported by the first workbench unit 112. The second workbench unit 114 is identical to the first workbench unit 112 and therefore supports the rotating shaft 111 in a same manner. With reference to FIG. 2, the first workbench unit 112 is fixedly provided with a pressing part 1145 corresponding to the support holes 125 at an edge of the second portion 112*a*, and the pressing part 1145 is used to maintain a free end of the rotating shaft, so as to restrict the rotating shaft to perform only rotational movement. The other free end of the rotating shaft 111 is restricted by another pressing part (not marked with a number) of the second workbench unit 114.

With reference to FIG. 1 to FIG. 3, the first workbench unit 112 and the second workbench unit 114 are hinged with each other by the rotating shaft 111 at a longitudinal edge, the longitudinal edge is close to the second portions of the first workbench unit 112 and the second workbench unit 114, so as to implement relative rotation of the first workbench unit 112 and the second workbench unit 114, so that the workbench unit 110 can be unfolded or folded, and after unfolding, the first working surface 1120 of the first workbench unit 112 and the second working surface 1140 of the workbench unit 114 can be spliced into a horizontal top surface (that is, the working surface 1100) for supporting the workpiece. The raised portions 1122*a*, 1122*b*, 1122*c*, and 1122*d* of the first workbench unit 112 shape-cooperate with the recessed portions of the second workbench unit 114, and the recessed portions 1123*a*, 1123*d*, 1123*c*, and 1123*d* of the first workbench unit 112 shape-cooperate with the raised portions of the second workbench unit 114, so as to form a complete, regular, and seamless rectangular working surface 1100. Certainly, the rotating shaft 111 may be integrally formed on the first workbench unit 112 or the second workbench unit 114 as long as the first workbench unit 112 and the second workbench unit 114 can rotate relative to each other.

With reference to FIG. 3, an axis (that is, an axial line of relative rotation) of the rotating shaft 111 is parallel to the longitudinal direction a of the first workbench unit 112. In this embodiment, the axial line is also parallel to the longitudinal direction of the second workbench unit 114. That is, the first workbench unit 112 and the second workbench unit 114 both rotate along the longitudinal direction thereof.

Figure 8:
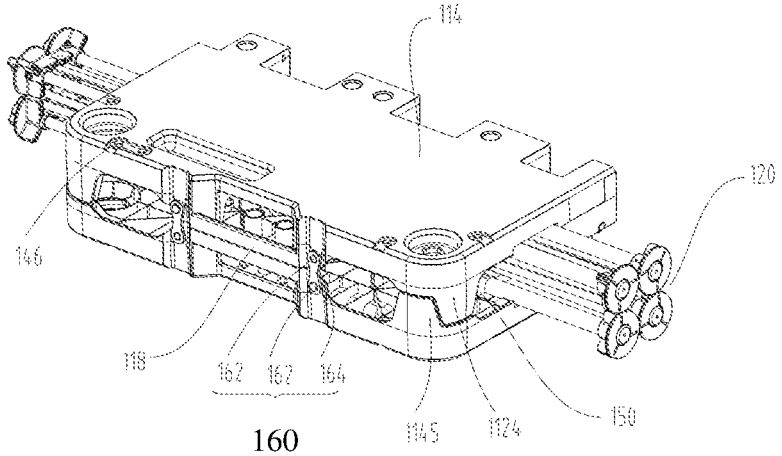
FIG. 8 is a perspective view of the workbench according to an example embodiment of the present invention, this moment the workbench is in a second state and the connecting piece is shown, but a specific structure of a working surface is not shown.
Figure 9:
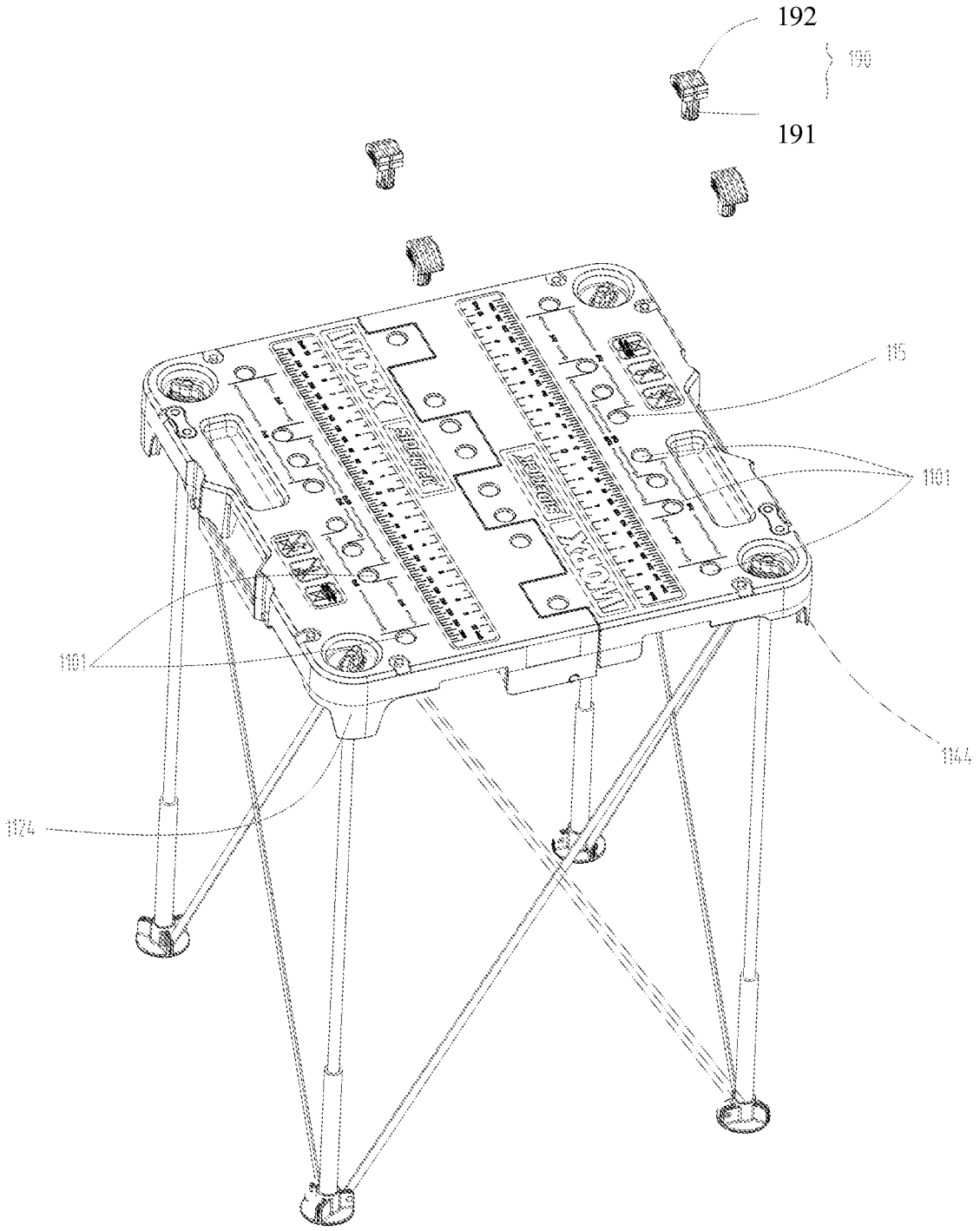
FIG. 9 is perspective view of the workbench according to an example embodiment of the present invention, this moment the workbench is in a first state and the workpiece is not shown.

FIG. 7 and FIG. 8 show that the bracket 120 is partially accommodated in the workbench unit 110 after the workbench being folded. With reference to FIG. 4, the first workbench unit 112 and the second workbench unit 114 relatively rotate around the rotating shaft 111 until the first workbench unit 112 and the second workbench unit 114 abut against each other. A bottom wall 1261 and two side walls 1262 of the concave portion 126 of the first workbench unit 112 and a bottom wall and side walls of another corresponding concave portion of the second workbench unit form a cuboid bracket placement cavity 140. The longitudinal ends of the bracket placement cavity are open, that is, the concave portion 126 of the first workbench unit 112 and another concave portion of the second workbench unit 114 form the bracket placement cavity 140. After the bracket 120 is folded, the support legs 122 are roughly arranged in a rectangle, the support legs 122 are clamped by inner walls of the bracket placement cavity 140, and the support leg mounting base is exposed, so that the bracket is restricted in a circumferential direction (a direction perpendicular to the inner walls of the bracket placement cavity). The bracket placement cavity 140 is further provided with an elastic skidproof pad 115, so as to restrict the bracket to move along an axis of the support legs, that is, preventing the bracket from sliding out from an opening.

With reference to FIG. 8 again, in an extension direction of the first leg portion 1124 and the second leg portion 1125, transverse dimensions of the first leg portion 1124 and the second leg portion 1125 gradually decrease along the extension direction, so that after the workbench unit 1100 are folded, the first leg portion 1124 and the second leg portion 1145 of the second workbench unit 114 are at least partially staggered and abut against each other, so as to implement shape cooperation (that is, a part with a large size cooperates with a part with a small size), that is, the first workbench unit 112 and the second workbench unit 114 abut against each other, restrict each other, and do not have relative movement, ensuring stability of the folded state of the workbench unit 110.

When the workbench unit are in the folded state, the first leg portion 1124 of the first workbench unit 112 and the second leg portion 1145 of the second workbench unit 114 cooperate to form a first curved outline 11240, the second leg portion 1125 of the first workbench unit and the first leg portion 1144 of the second workbench unit cooperate to form a second curved outline 11250, the first curved outline 11240 is connected to the first side surface 1126 and the second side surface 1127, and the second curved outline 11250 is connected to the first side surface 1126 and the third side surface 1128, so as to form a stable accommodation structure.

Certainly, if the bracket is to be clamped stably, a connection structure needs to be set at sides, far away from the rotating shaft, of the first workbench unit 112 and the second workbench unit 114. The workbench may further include a detachable connecting piece 160, the connecting piece 160 includes a main body part 164 and connecting parts 162 located on two opposite sides of the main body part. The connecting parts 162 are hole-shaped. The first workbench unit 112 and the second workbench unit 114 are provided with a pair of columnar protrusions 1129 and 1149 at the sides respectively, the sides are far away from the rotating shaft. The connecting parts 162 are sleeved and connected to the columnar protrusions 1129 and 1149 so as to maintain the first workbench unit 112 and the second workbench unit 114. A handle 118 is formed between the two protrusions 1129 (or two protrusions 1149). The connecting piece 160 and the protrusions 1129 and 1149 may be not provided. When a user holds the handle 118, a griping force causes the bracket 120 to be directly clamped by the inner walls of the bracket placement cavity 140. Certainly, such design requires the user to apply a greater force, and user experience is relatively poor.

In addition, the raised portions of the first workbench unit 112 and the second workbench unit 114 can be used as support of a whole structure and is in direct contact with the ground. In addition, the handle 118 is made to be located at a certain height, to facilitate fetching of the user.

The foregoing embodiments express only several implementations of the present invention and are described relatively specifically and in detail, but cannot be understood as limitation to the invention patent scope. It should be noted that for a person of ordinary skill in the art, various transformations and improvements can further be made without departing from the idea of the present invention and all fall within the protection scope of the present invention. Therefore, the protection scope of the present invention patent should be subject to the appended claims.

What is claimed is:

1. A workbench, comprising:

a workbench unit, comprising two sub workbench units which are identical in structure and size, wherein the sub workbench unit is provided with a sub working surface, the sub working surfaces of the sub workbench units adjoin to jointly form a working surface, the sub workbench unit comprises a first portion extending along a longitudinal direction and a second portion adjacent to the first portion, and the second portion comprises multiple raised portions spaced from each other and recessed portions corresponding to the raised portions, and the raised portions extend from the first portion in a manner of being perpendicular to the longitudinal direction;

a rotating shaft, pivotally connected to the two sub workbench units and extending through the second portion of the two sub workbench units, wherein the first portion defines a central line perpendicular to the longitudinal direction, a distance between a center of any raised portion to the central line is equal to a distance between a center of any corresponding recessed portion to the central line, a dimension of any raised portion along the longitudinal direction is equal to a dimension of any corresponding recessed portion along the longitudinal direction;

wherein the first portion defines the longitudinal direction, the first portion is provided with n positioning holes arranged along the longitudinal direction, the positioning holes are arranged to form a first positioning hole group, the second portion is provided with n/2 positioning holes arranged along the longitudinal direction, n is an even number greater than 0, and the positioning holes of the second portion and some of the positioning holes of the first portion are symmetric with respect to a straight line parallel to the longitudinal direction; and wherein after the two sub workbench units cooperate, three longitudinally spaced positioning hole groups are formed, in every positioning hole group, the spacing between corresponding positioning holes is the same, centers of the positioning holes of the second portions of the two sub workbench units are collinear so that a second positioning hole group is formed, and the first positioning hole group and the second positioning hole group are symmetric with respect to a straight line parallel to the longitudinal direction.

2. The workbench according to claim 1, wherein the sub workbench unit is provided with a first leg portion and a second leg portion, the first leg portion and the second leg portion extend from the surface opposite the sub working surface, and after the two sub workbench units cooperate, the first leg portions and the second leg portions support the workbench.

3. A workbench, comprising:

a workbench unit, comprising two sub workbench units which are identical in structure and size, wherein the sub workbench unit is provided with a sub working surface, the sub working surfaces of the sub workbench units adjoin to jointly form a working surface, the sub workbench unit comprises a first portion extending along a longitudinal direction and a second portion adjacent to the first portion, and the second portion comprises multiple raised portions spaced from each other and recessed portions corresponding to the raised portions, and the raised portions extend from the first portion in a manner of being perpendicular to the longitudinal direction;

a rotating shaft, pivotally connected to the two sub workbench units and extending through the second portion of the two sub workbench units, wherein the first portion defines a central line perpendicular to the longitudinal direction, a distance between a center of any raised portion to the central line is equal to a distance between a center of any corresponding recessed portion to the central line, a dimension of any raised portion along the longitudinal direction is equal to a dimension of any corresponding recessed portion along the longitudinal direction;

wherein the first portion defines the longitudinal direction, the first portion is provided with n positioning holes arranged along the longitudinal direction, the positioning holes are arranged to form a first positioning hole group, the second portion is provided with n/2 positioning holes arranged along the longitudinal direction, n is an even number greater than 0, and the positioning holes of the second portion and some of the positioning holes of the first portion are symmetric with respect to a straight line parallel to the longitudinal direction;

wherein after the two sub workbench units cooperate, three longitudinally spaced positioning hole groups are formed, in every positioning hole group, the spacing between corresponding positioning holes is the same, centers of the positioning holes of the second portions of the two sub workbench units are collinear so that a second positioning hole group is formed, and the first positioning hole group and the second positioning hole group are symmetric with respect to a straight line parallel to the longitudinal direction; and wherein the second portion comprises a first recessed portion, a first raised portion, a second recessed portion, a second raised portion, a third recessed portion, a third raised portion, a fourth recessed portion, and a fourth raised portion, which are sequentially arranged along the longitudinal direction, and the positioning holes of the second portion comprise a first positioning hole disposed in the first raised portion, two second positioning holes disposed in the second raised portion, and a third positioning hole disposed in the third raised portion.

4. The workbench according to claim 3, wherein the sub workbench unit is provided with a first leg portion and a second leg portion, the first leg portion and the second leg portion extend from the surface opposite the sub working surface, and after the two sub workbench units cooperate, the first leg portions and the second leg portions support the workbench.

* * * * *